US005098218A

United States Patent [19]

Reese et al.

[11] Patent Number: 5,098,218

[45] Date of Patent: Mar. 24, 1992

[54] METHOD AND ARTICLE OF MANUFACTURE FOR REMOVABLE PAVEMENT FOR UNDERGROUND UTILITY PLACEMENT

[75] Inventors: Robert W. Reese, Christiana; Stephen W. Keech, Morgantown, both of Pa.

[73] Assignee: Bull Dog Construction Co., Inc., Coatesville, Pa.

[21] Appl. No.: 549,878

[22] Filed: Jul. 9, 1990

[51] Int. Cl.[5] ..... E01C 5/22

[52] U.S. Cl. ..... 404/35; 404/41

[58] Field of Search ..... 404/17, 18, 33, 34, 404/35, 41

[56] References Cited

U.S. PATENT DOCUMENTS

| | | | |
|---|---|---|---|
| 1,991,931 | 2/1935 | Kling et al. | 404/17 |
| 3,092,371 | 6/1963 | Knudsen | 404/6 X |
| 3,202,067 | 8/1965 | Michard et al. | 404/17 |
| 3,236,991 | 2/1966 | Graham et al. | 219/213 |
| 3,301,147 | 1/1967 | Clayton et al. | 404/35 |
| 3,679,531 | 7/1972 | Wienand et al. | 428/195 X |
| 3,859,000 | 1/1975 | Webster | 404/41 |
| 4,376,596 | 3/1983 | Green | 404/35 |
| 4,568,584 | 2/1986 | Holland | 428/44 |
| 4,826,351 | 5/1989 | Haberhauer et al. | 404/35 |
| 4,845,907 | 7/1989 | Meek | 52/177 |

FOREIGN PATENT DOCUMENTS

| | | | |
|---|---|---|---|
| 2610955 | 8/1988 | France | 404/35 |

*Primary Examiner*—William P. Neuder
*Attorney, Agent, or Firm*—Michael F. Petock

[57] ABSTRACT

Removable sidewalk and a method of installation involves preformed sidewalk slabs provided with interlocking means at two opposite ends. The slabs include attachment means for lifting the slabs into place. The slabs may be installed over utility services to form a sidewalk and removed and replaced as necessary to provide access to the underground utilities.

9 Claims, 2 Drawing Sheets

FIG. 1
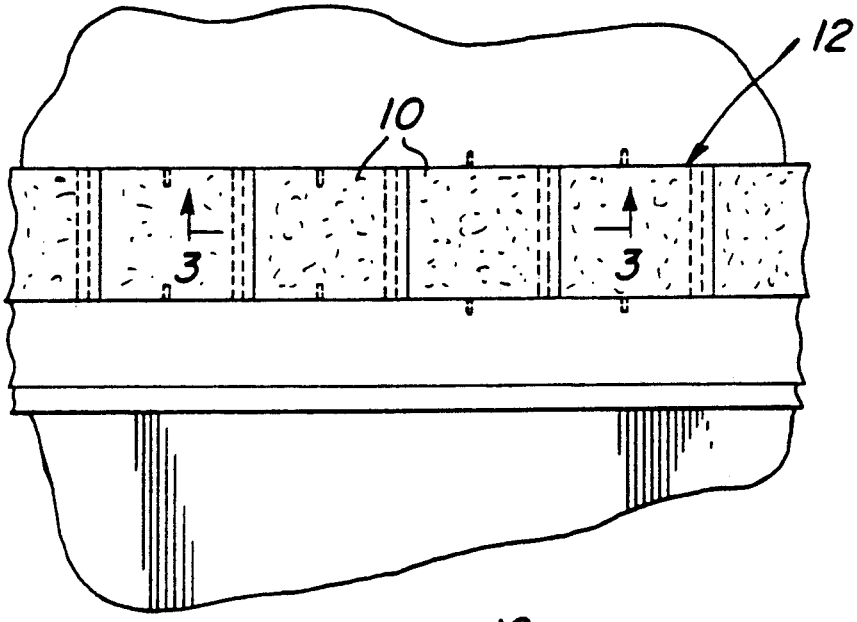
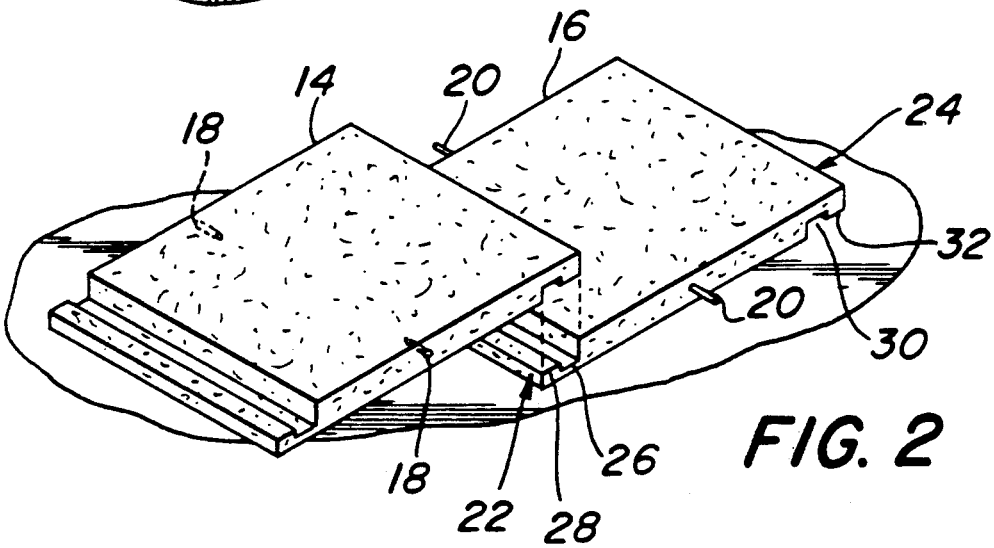
FIG. 2
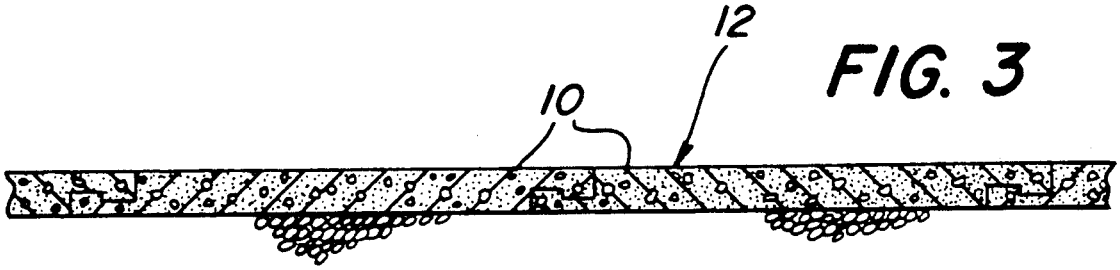
FIG. 3

METHOD AND ARTICLE OF MANUFACTURE FOR REMOVABLE PAVEMENT FOR UNDERGROUND UTILITY PLACEMENT

BACKGROUND OF THE INVENTION

The present invention relates to a method and article of manufacture for installing sidewalk or pavement. More particularly, it relates to pavement or sidewalk under which underground utilities of all types may be laid. The terms "pavement" and "sidewalk" will be used interchangeably throughout.

There has been a growing tendency over the last twenty or thirty years to place the utilities such as electric lines, gas, water and sewer pipe lines underground, within a public right of way where access for repair work when necessary can be gained without conflicts with individual property owners. In many instances, there is a problem as to where these lines are to be placed. The problem is particularly acute in new residential and commercial development where there is a limited right of way, and particularly after an area usually approximately four feet wide is eliminated for a sidewalk, there is little area left. This is particularly a problem when there is some other obstruction in the area. The utility companies are often reluctant to place their utility lines under normal (prior art) sidewalk since if it is necessary to gain access to them, the sidewalk would need to be jackhammered out and then replaced by the building of forms and the pouring of concrete after the work on the utility lines is done.

The present invention addresses these problems.

SUMMARY OF THE INVENTION

In accordance with the present invention, an article of manufacture and a method of installing sidewalks is provided wherein the sidewalk may be easily installed, and be removed and again replaced easily if there is need to gain access to the area underneath the sidewalk, such as for the service of utility lines (gas pipe lines, water pipe lines, electric wire lines, etc.). The present invention provides particular advantage in the placement of underground utility lines where there are problems or restrictions due to the limited rights of way of the utility companies.

Briefly, in accordance with the present invention, a method is provided of installing sidewalk comprising the steps of providing a plurality of sidewalk slabs each having a pair of interlocking means provided for opposite edges with the sidewalk slabs being lifted into position to form a sidewalk in such a manner so as to provide and enable the adjacent edges of the slabs to be interlocked whereby the slabs may be removed by lifting and replaced as needed.

The slabs comprise an article of manufacture wherein a plurality of sidewalk slabs would be utilized to form the sidewalk. In a preferred embodiment, although other compositions may be utilized, the sidewalk slabs would be composed of precast concrete. The plurality of sidewalk slabs would be provided with interlocking means provided for two opposite edges. The interlocking means would be adapted and configured to maintain the edges of adjacent slabs substantially free of movement, one with respect to the other, each slab being provided with means for the attachment of a lifting means.

BRIEF DESCRIPTION OF THE DRAWINGS

For the purpose of illustrating the invention, there are shown in the drawings forms which are presently preferred; it being understood, however, that this invention is not limited to the precise and instrumentalities shown.

FIG. 1 is a plan view of a plurality of sidewalk slabs in accordance with the present invention.

FIG. 2 is a view in perspective of two sidewalk slabs in accordance with the present invention, one being placed adjacent to the other.

FIG. 3 is a cross-sectional view taken along line 3—3 of FIG. 1.

DETAILED DESCRIPTION OF THE PREFERRED EMBODIMENTS

Figure 4:
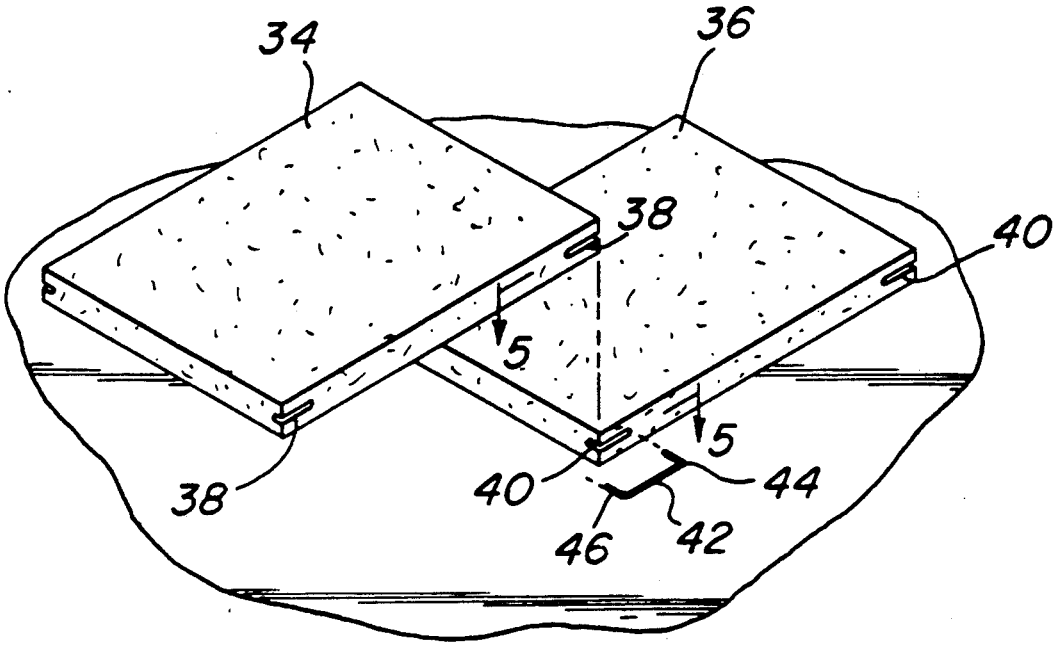
FIG. 4 is a view in perspective, similar to that of FIG. 2, showing another embodiment of the present invention.

Referring now to FIG. 1, there is shown a plurality of slabs 10 which form a sidewalk 12. Slabs 10 may be comprised of precast poured concrete or any other suitable sidewalk material, including synthetic plastics. From a cost point of view and the esthetic point of view of providing a real sidewalk with conventional slip resistance and other characteristics normally found in concrete sidewalks, it is presently preferred that the slabs would be comprised of precast concrete. However, synthetic plastics and other materials may be utilized.

Slabs 10 may be any of desired form which would be suitable for the purposes of the present invention, i.e. sidewalk or pavement. Although the sidewalk slabs may be made four feet wide by four feet long, or any other conventional and desired dimension. In a preferred method of practicing the invention, slabs of different lengths would be available to enable the overall sidewalk length to be selected other than in multiples of four feet. The slabs are provided with a means of attaching a lift means such as hooks and cable or hooks and chain on a small crane, backhoe or the like.

FIG. 2 illustrates two adjacent slabs, with slab 14 being lifted into place adjacent slab 16. Slab 14 is shown with holes or indentations 18 which may be utilized to attach hooks or other lifting means. Slab 16 is shown to be provided with pins 20 to which a lifting means may be attached. The same two alternative embodiments of attachment means are shown in FIG. 1. These two alternatives are merely illustrative, and it will be clear to those skilled in the art that various other equivalent attachment means may be utilized.

As may be seen in FIGS. 1 through 3, the slabs are placed adjacent to each other. The slabs, at two opposite ends, are provided with some form of interlocking means. For example, slab 16 is provided with an interlocking means at opposite ends 22 and 24 which runs along the edge of each opposite end. In the embodiment shown in FIGS. 1, 2 and 3, the interlocking means may take the form of formations formed within the concrete, such as the upwardly directed channel 26 and rib 28 at end 22 and the downwardly directed channel 30 and rib 32 at end 24. Examination will reveal that slab 14, insofar as the interlocking end formations are concerned, is identical to slab 16. In practice, the slabs 10, 14, 16, etc. utilized in the construction of a single sidewalk would normally be identical, except for one or more possibly being of a different length. They are shown in FIGS. 1 and 2 with different attachments for lifting means solely for the purpose to illustrate that the attachment means may take various forms.

The cross-sectional view in FIG. 3 illustrates, in conjunction with FIG. 1, the manner in which the interlocking means at the edges interlocks the pavement slabs.

Figure 5:
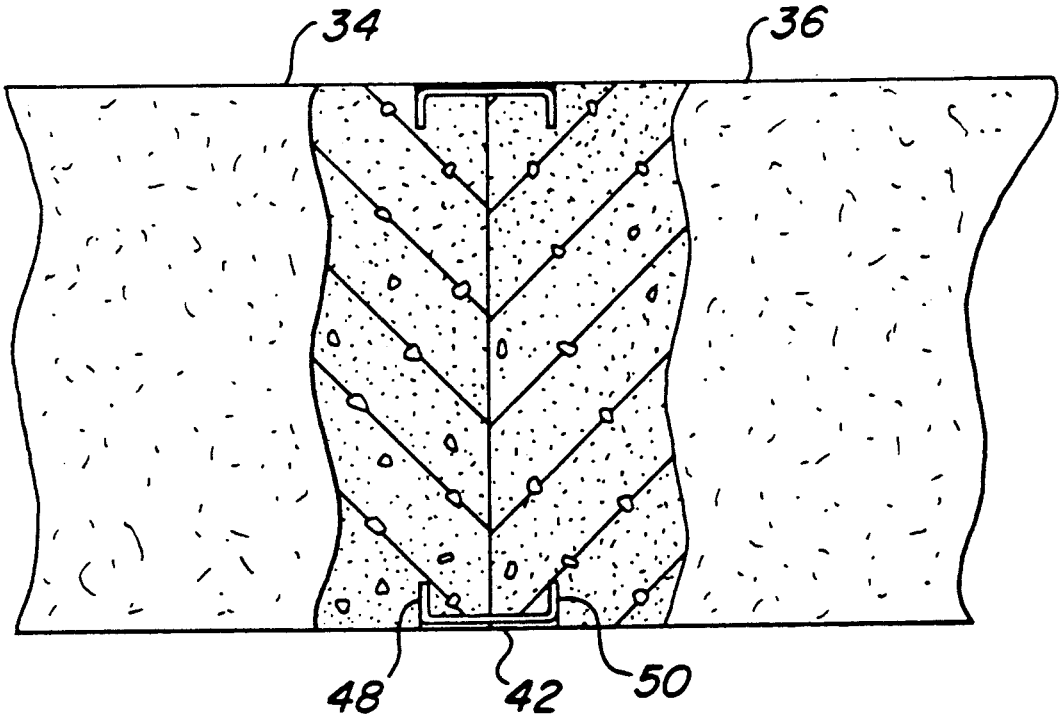
FIG. 5 is a plan view, partially broken away, of the embodiment of the invention shown in FIG. 4 with the interlocking means in place.

Referring now to FIGS. 4 and 5, there is shown another embodiment of an interlocking means in accordance with the present invention. The interlocking means of the present invention may take various forms, and the forms illustrated herein are merely for the purposes of illustration. The interlocking means may run along the entire edge, may be intermittent along the edge or may be pins or fasteners, of one form or another, one form of which is illustrated in FIGS. 4 and 5.

Referring now to FIGS. 4 and 5, there is shown slabs 34 and 36. In FIG. 4, slab 34 is being lowered, or as shown, offset from slab 36 for the purpose of illustration. Each of the slabs are provided with grooves or channels 38 and 40 at each of the four corners. The channels run substantially horizontally when the slabs are in place, or in other words substantially parallel with the face of the slabs. The channels are located along the sides of the slabs and are provided with a hole or bore on the inside end. The pins 42 are preferably as shown at 42, which are generally U-shaped with an extended and straight bottom. Pin 44 is provided with two prongs or extensions of the U which fit into the holes in the slabs which are shown more clearly in FIG. 5 as holes 48 and 50 respectively. The bottom portion of U-shaped bar 42 between pins 46 and 44 fits into the groove formed by grooves 38 and 40 in slabs 34 and 36, respectively, and functions to both hold the slabs together and to prevent one slab from rising with respect to the other. In other words, the slabs are prevented from relative movement in that they can neither pull apart nor move up or down with respect to each other. Again, the interlocking means provided at two opposite ends of the slabs enables the slabs to be maintained in place and prevents relative movement between them.

As illustrated, the interlocking means may take various shapes and forms. Numerous other variations of such interlocking means would be readily apparent to those skilled in the art and are understood to be covered within the scope of the present invention. Some examples include grooves and projections along opposite edges in which the grooves indent into the lateral edge and the projections extend from the lateral edge. Further, the U-shaped bar of FIGS. 4 and 5 may be utilized in conjunction with the interlocking structure of FIG. 1. In a similar manner, various other variations in the structure may be utilized for the attachment means, for example, U-shaped or eye hooks in the sides; or incomplete holes, notches or grooves in the underside of the slabs near the lateral edges which may be engaged by hooks; or even a piece of magnetic material, such as iron, embedded within the slab wherein the slab may be picked up by a magnetic crane. Further, as described above, the slabs themselves may be constructed of various materials including concrete which has been reinforced with reinforcing bar, wire mesh, nylon mesh or the like.

In view of the above, the present invention may be embodied in other specific forms without department from the spirit or essential attributes thereof and, accordingly, reference should be made to the appended claims, rather than to the foregoing specification as indicating the scope of the invention.

We claim:

1. An article of manufacture for providing a sidewalk, comprising: a plurality of sidewalk slabs provided with interlocking means provided for two opposite edges, said interlocking means adapted and configured to maintain the edges of adjacent slabs in engagement with restricted movement, one with respect to the other, each slab being provided with means for the attachment of a lifting means, wherein said mans for attachment comprises means extending from the lateral sides of the sidewalk slab, said means being formed into the slab and said means being adapted to have a lifting hook connected thereto.

2. An article of manufacture in accordance with claim 1 wherein said slabs are rectangular in shape.

3. An article of manufacture in accordance with claim 1 wherein said slabs are constructed of concrete.

4. An article of manufacture in accordance with claim 1 wherein said interlocking means is comprised of interlocking shapes comprised of concrete.

5. An article of manufacture in accordance with claim 1 wherein said interlocking means is comprised of the same material as the sidewalk slab, said interlocking means being in the shape of an upwardly directed channel at one end and a downwardly directed channels at the opposite end of the slab thereby enabling removal of each individual slab after installation utilizing said means for attachment of a lifting means.

6. An article of manufacture for providing a sidewalk, comprising: a plurality of sidewalk slabs provided with interlocking means provided for two opposite edges, said interlocking means adapted and configured to maintain the edges of adjacent slabs in engagement with restricted movement, one with respect to the other, each slab being provided with means for the attachment of a lifting means, wherein said interlocking means is comprised of a substantially U-shaped pin, a portion of which is adapted to fit into a groove in said concrete slab, said groove being in the end of said slab and said substantially U-shaped pin being adapted to bridge two adjacent concrete slabs.

7. An article of manufacture in accordance with claim 6 wherein said means for attachment comprises lifting hooks.

8. An article of manufacture in accordance with claim 6 wherein said means for attachment of a lifting means is comprised of holes formed in said slabs.

9. A method of installing public utility access means to a building under a sidewalk, comprising the steps of:

installing the necessary public utility access means in the ground in the area where the sidewalk is to be placed;

providing a plurality of sidewalk slabs each having a pair of interlocking means provided for opposite ends of each slab; and lifting said slabs into position to form a sidewalk in such manner to provide and enable the adjacent edges of adjacent slabs to be interlocked in place whereby said slabs may be removed later as needed by lifting and replaced.

* * * * *

UNITED STATES PATENT AND TRADEMARK OFFICE

CERTIFICATE OF CORRECTION

PATENT NO. : 5,098,218

DATED : March 24, 1992

INVENTOR(S) : Robert W. Reese & Stephen W. Keech

It is certified that error appears in the above-identified patent and that said Letters Patent is hereby corrected as shown below:

Column 4, line 2, delete "department" and insert -- departing --

Column 4, line 15, delete "mans" and insert -- means --.

Column 4, line 31, delete "channels" and insert -- channel --.

Signed and Sealed this

Eighth Day of June, 1993

Michael K. Kirk

*Attest:*

MICHAEL K. KIRK

*Attesting Officer*

*Acting Commissioner of Patents and Trademarks*